US008002979B2

(12) United States Patent
Bryan-Brown

(10) Patent No.: US 8,002,979 B2
(45) Date of Patent: Aug. 23, 2011

(54) WASTE DISPOSAL SYSTEM

(76) Inventor: Michael J. Bryan-Brown, Bainbridge Island, WA (US)

( * ) Notice: Subject to any disclaimer, the term of this patent is extended or adjusted under 35 U.S.C. 154(b) by 1261 days.

(21) Appl. No.: 11/651,812

(22) Filed: Jan. 10, 2007

(65) Prior Publication Data

US 2008/0164191 A1 Jul. 10, 2008

(51) Int. Cl.
*B01D 35/02* (2006.01)
*B02C 23/10* (2006.01)

(52) U.S. Cl. ..... 210/173; 210/251; 71/14; 71/23; 435/290.1; 435/290.4; 241/46.013; 241/46.014; 241/24.11; 241/DIG. 38

(58) Field of Classification Search ..... None
See application file for complete search history.

(56) References Cited

U.S. PATENT DOCUMENTS 2,832,546 A * 4/1958 Sprague ..... 241/46.01
3,823,879 A * 7/1974 Johnson ..... 241/101.2
4,183,470 A * 1/1980 Hovartos et al. ..... 241/46.013
4,337,901 A 7/1982 Ogura
5,127,587 A * 7/1992 Johnson ..... 241/46.013
5,732,724 A * 3/1998 Becknell ..... 134/107
5,971,303 A * 10/1999 Pugh-Gottlieb ..... 241/46.013
6,576,140 B1 * 6/2003 Batten ..... 210/744
6,629,652 B2 * 10/2003 Batten ..... 241/24.11
2006/0283991 A1 * 12/2006 Nishikawa et al. ..... 241/46.013
2007/0001039 A1 * 1/2007 Steinbeck ..... 241/46.013
2007/0181719 A1 * 8/2007 Berger et al. ..... 241/46.013
2008/0164191 A1 * 7/2008 Bryan-Brown ..... 210/173
2009/0179097 A1 * 7/2009 Nishikawa et al. ..... 241/46.013

* cited by examiner

*Primary Examiner* — Robert James Popovics
(74) *Attorney, Agent, or Firm* — Olympic Patent Works PLLC

(57) ABSTRACT

Various embodiments of the present invention are directed to waste disposal methods and systems. In one embodiment of the present invention, a waste disposal system is positioned under a sink in a building connected to a septic system for disposal of food waste and wastewater. The waste disposal system includes a grinding chamber, a centrifugal-pump chamber, and a straining chamber for separating food waste from wastewater. The straining chamber includes a filtration basket, and an outlet pipe.

4 Claims, 11 Drawing Sheets

--Prior Art--

--Prior Art--

--Prior Art--

--Prior Art--

--Prior Art--

WASTE DISPOSAL SYSTEM

TECHNICAL FIELD

The present invention relates to waste disposal, and, in particular, to garbage disposals.

BACKGROUND OF THE INVENTION

Garbage disposals are electrically-powered devices that may be installed under a sink for disposing of food waste. For example, a user can rinse shredded food waste down a kitchen sink when cleaning dishes, rather than stopping to scrape food waste into a garbage can. A kitchen garbage disposal shreds the food waste into small pieces to enable the passage of the food waste through the waste piping system that connects the kitchen drain, to which the garbage disposal is attached, to a municipal sewer system or septic tank.

FIG. 1A shows a side view of an exemplary garbage disposal installed under a sink. A garbage disposal 100 is attached to a sink 102 and positioned between a dishwasher drain hose 104 and a piping U-bend 106. FIG. 1B shows a cross-sectional view of the garbage disposal shown in FIG. 1A. Food waste is shred in the garbage disposal 100 by a shredder ring 108 which is powered by a motor 110. Food waste is deposited through a flanged opening 112, into an upper chamber 114 of the garbage disposal 100, and drops onto a turntable 116. When the garbage disposal is turned on, food waste is forced outward by centrifugal forces to the perimeter of the turntable 116 and against the shredder ring 108. The shredder ring 108 includes a number of notches with sharp edges for cutting. Two hammers 118 and 120, loosely attached to the turntable 116 to allow for movement of the hammers on the turntable 116, assist in forcing food waste through the shredder ring 108. The notches of the shredder ring 106 shave food waste into small chips that fall into the lower chamber 122 of the garbage disposal. A constant flow of water from a kitchen sink discharges the shredded food waste from the lower chamber 122, out through a disposal outlet 124, and into the waste piping system of a building. However, the discharge of shredded food waste from a garbage disposal into the waste piping system of a building may result in blocking and back-ups in the piping systems, and overloading of municipal sewer systems.

Some waste piping systems are connected to septic systems, which are small-scale sewage treatment systems that are common in areas with no connection to a municipal sewage system. FIG. 2 shows a side view of a septic system located adjacent to a residence. A septic system 200 includes a septic tank 202 attached to a drainage field 204 for disposal of treated wastewater ("effluent") 206. Wastewater from utilities, such as a toilet 208, a shower 210, and a sink 212, flows through an underground septic-tank-wastewater inlet pipe 214 to a septic tank 202 that includes a first chamber 216 and a second chamber 218. Wastewater in the septic tank 202 flows into the first chamber 216, depositing solid particles that, over time, create a sludge layer 220. Anaerobic bacteria continuously decompose the sludge layer 220, slowing the build-up of sludge in the first chamber 216 of the septic tank 202.

FIG. 3 shows a cross-sectional view of the septic tank from the septic system shown in FIG. 2. The first chamber 216 and second chamber 218 of the septic tank 202 are formed by a dividing wall 302 that includes an opening 306 located about midway between the top and bottom of the septic tank 202. After a sludge layer 220 is formed in a first chamber 216 of the septic tank 202, the liquid component of the wastewater flows through the dividing wall 302 into the second chamber 218 where further settlement of solid particles takes place, creating a second sludge layer 306. Finally, the wastewater flows through an effluent filter 308 and is disposed of as effluent 206 through the piping network of the drainage field 204, as shown in FIG. 2.

When a septic system is treating wastewater that includes shredded food waste from a garbage disposal, sludge layers can rapidly accumulate, and anaerobic bacteria may be unable to adequately slow down the build-up of the sludge layers 220 and 306. An increased rate of sludge deposition may eventually block the flow of wastewater through a dividing wall 302 and result in failure of the septic system 200. Shredded food waste from a garbage disposal can also create oil-in-water emulsions, causing build-up and eventual blockage of piping and drainage fields. Consequently, some communities have banned the use of garbage disposals in buildings connected to septic systems.

The controlled decomposition of organic matter under aerobic conditions, one form of composting, is an alternative method for disposing of food waste. Composting can be performed by various organisms, including microorganisms, and invertebrates such as, nematodes, and worms. One type of composting, referred to as "vermicomposting," produces compost from food waste by using a species of worms adapted to composting, such as Brandling Worms (*Eisenia foetida*) or Redworms (*Lumbricus rubellus*). The addition of Brandling Worms or Redworms can accelerate the composting process. FIG. 4 shows a exploded view of a vermicomposting bin. A continuous-vertical-flow vermicomposting bin ("bin") 400 for disposing of food waste includes a vertically stacked series of composting trays 402, 404 and 406 above a collection tray 408. A user loads the bin 400 by adding a layer of bedding material to the bottom of the first composting tray 402, and then adding worms and organic matter in another layer. An additional layer of bedding material is then added on top of the layer of worms and organic matter. The second composting tray 404 is first filled with organic matter followed by a layer of bedding material. The third composting tray 406 is filled with organic matter.

During operation, the collection tray 408 catches excess liquid that is produced during the decomposition process and that is drained through a spout 412. Holes 414 and 416 in the top of the bin 400, and on the bottom of the composting trays 402, 404 and 406, allow air to flow through the bin. The bin 400 operates by the ascending vertical migration of worms from the first composting tray 402 up to the third composting tray 406. Worms 410 added to the first composting tray 402 migrate upward towards the layers of organic matter, a food source, after composting the layer of organic matter in the first composting tray 402, and second composting tray 404. After the worms 410 have migrated upward from a first or second composting tray, the first or second composting tray contains composted organic material that can be collected. At the end of operation, many of the worms 410 have migrated to the third composting tray 406, and can be removed when the organic matter layer in the third composting tray 406 has been decomposed.

Maintaining optimum conditions for worms in a vermicomposting bin can be difficult, as worms are adapted to specific conditions in soils. Worms used in composting prefer temperatures of between fifty-five to seventy-five degrees Fahrenheit and can die in temperatures below freezing or above ninety degrees Fahrenheit. Users may also find it difficult to maintain a continuous-vertical-flow vermicomposting bin stored outside due to fluctuations in temperature and moisture. Odors may be produced by continuous-vertical-flow vermicomposting bins, and may attract organisms that spread pathogens, such as rats, and undesirable insects, such as flies. As a result, users often chose to store bins outside. However, vermicomposting worms do not thrive in unregulated environments. Worms prefer food waste to be macerated or partially decomposed prior to ingestion. Users often lack time and interest to macerate the food waste prior to loading a continuous-vertical-flow vermicomposting bin to speed the composting process. Users need also to regularly inspect and adjust moisture levels so that worms and microorganisms can rapidly degrade food waste. Users, manufacturers, and vendors of food waste disposal systems have, therefore, recognized a need for a food waste disposal system that can efficiently dispose of food waste, while also minimizing the negative impacts on municipal and private sewer treatment systems.

SUMMARY OF THE INVENTION

Various embodiments of the present invention are directed to waste disposal methods and systems. In one embodiment of the present invention, a waste disposal system is positioned under a sink in a building connected to a septic system for disposal of food waste and wastewater. The waste disposal system includes a grinding chamber, a centrifugal-pump chamber, and a straining chamber for separating food waste from wastewater. The strainer includes a filtration basket, and an outlet pipe.

DETAILED DESCRIPTION OF THE INVENTION

Figure 1A:
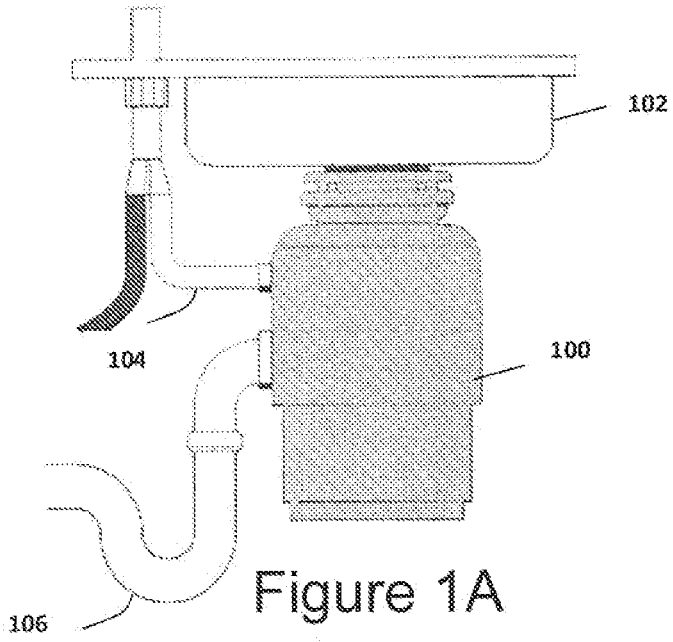
FIG. 1A shows a side view of an exemplary garbage disposal installed under a kitchen sink.
Figure 1B:
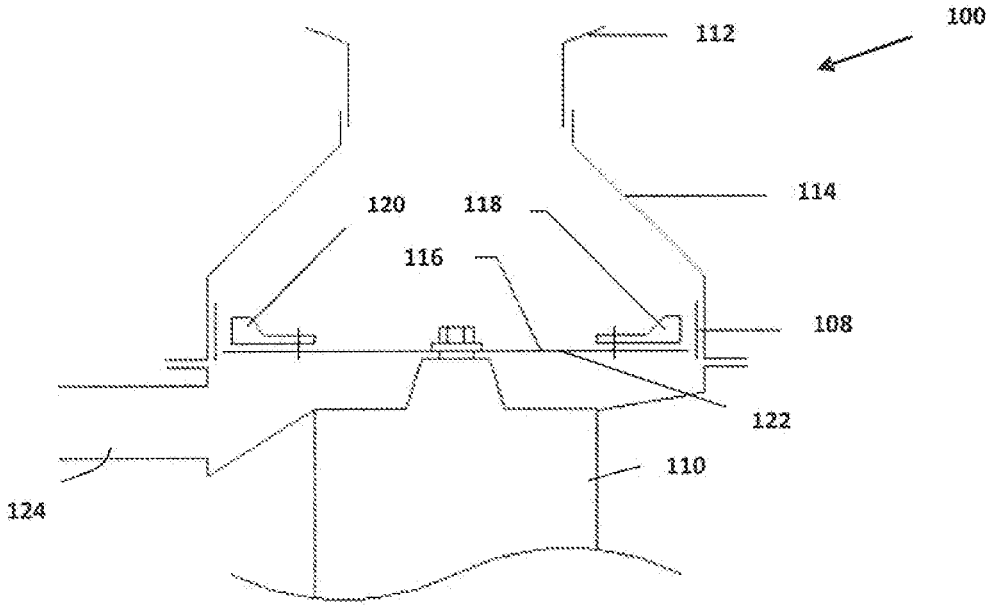
FIG. 1B shows a cross-sectional view of the garbage disposal shown in FIG. 1A.
Figure 2:
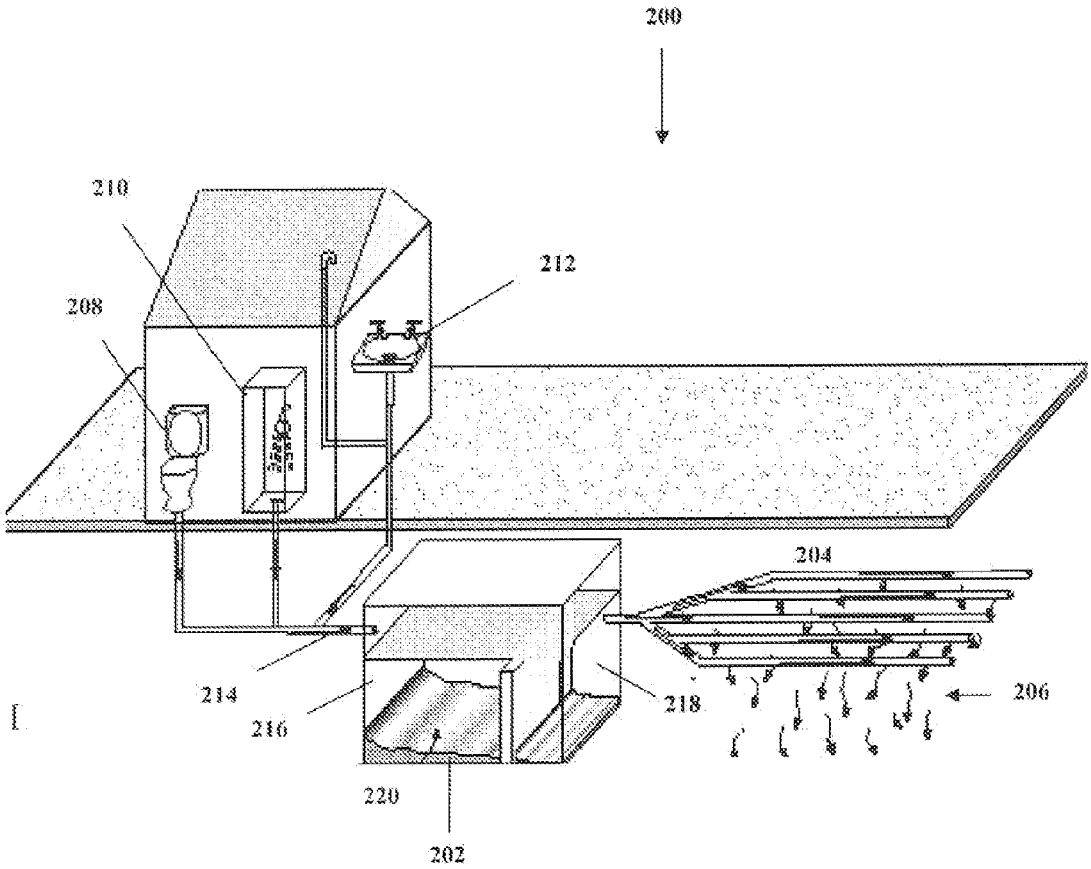
FIG. 2 shows a side view of a septic system located adjacent to a residence.
Figure 3:
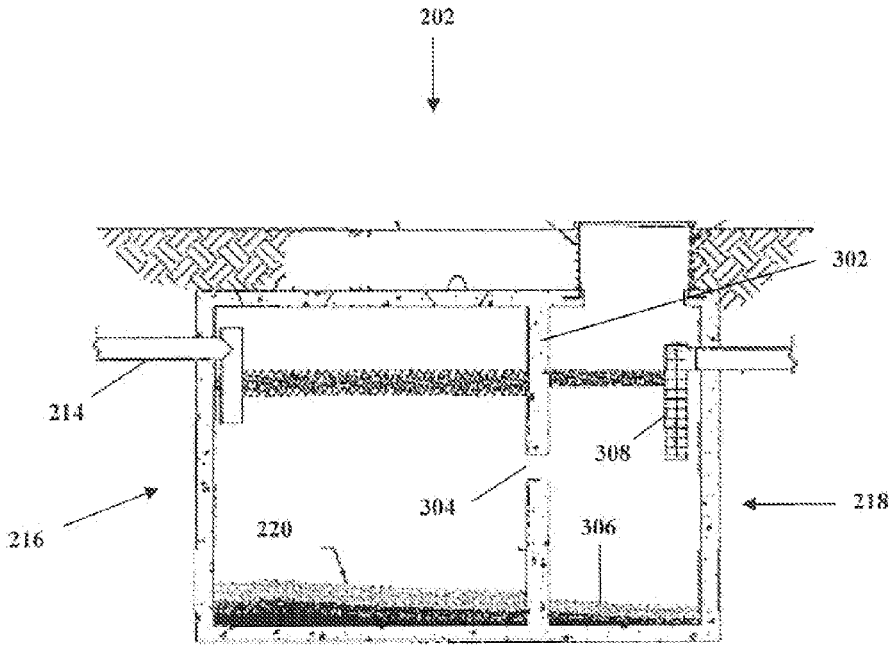
FIG. 3 shows a cross-sectional view of a septic tank from the septic system shown in FIG. 2.
Figure 4:
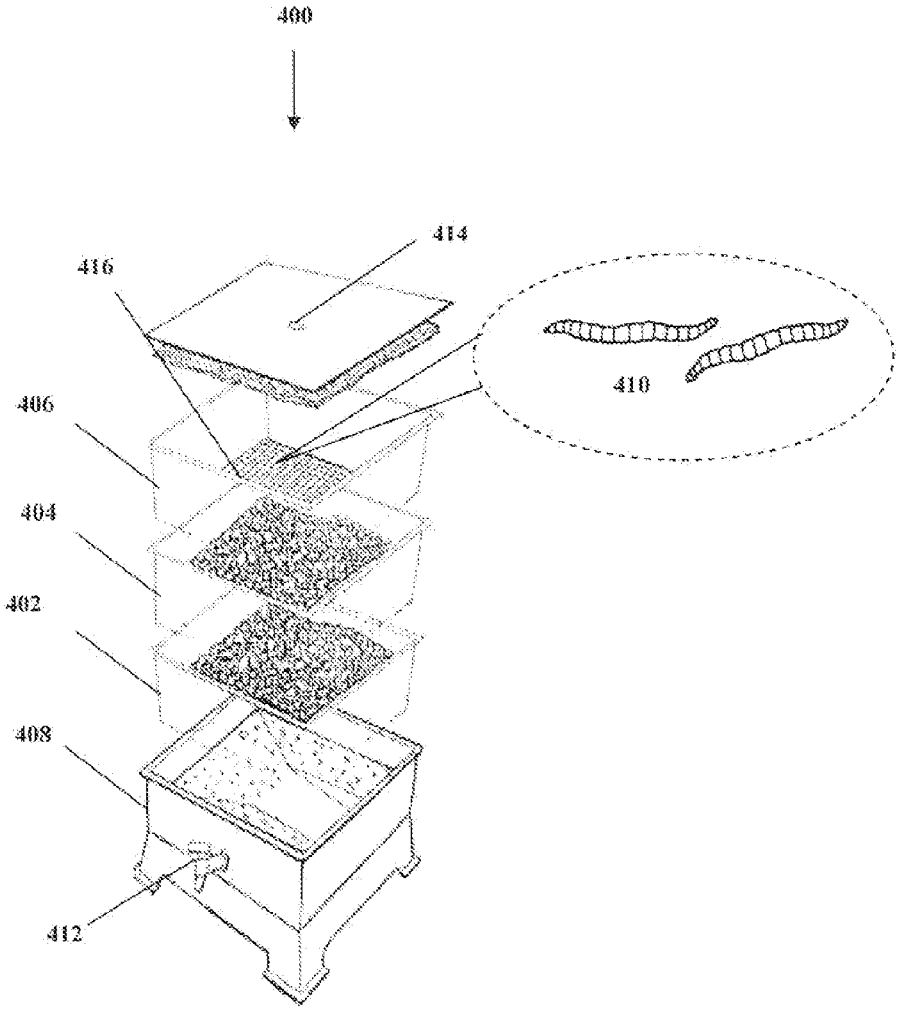
FIG. 4 shows a exploded view of a vermicomposting bin.
Figure 5:
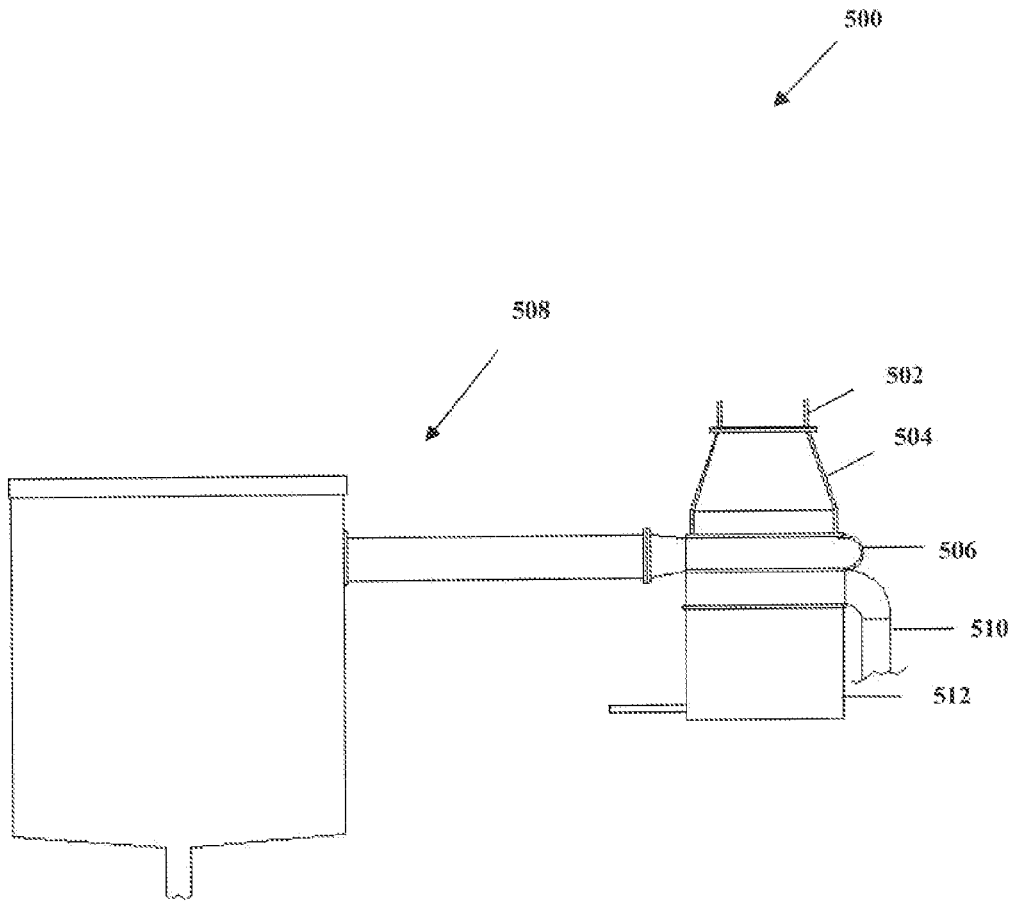
FIG. 5 shows a side view of a waste disposal system including a straining chamber that represents an embodiment of the present invention.

Various embodiments of the present invention are directed to waste disposal methods and systems, particularly waste disposal systems that can be used in buildings connected to septic systems. FIG. 5 shows a side view of a waste disposal system including a straining chamber that represents an embodiment of the present invention. The waste disposal system 500 includes a disposal inlet 502, a grinding chamber 504, a centrifugal-pump chamber 506, a straining chamber 508, a disposal outlet 510, and a motor 512.

Figure 6A:
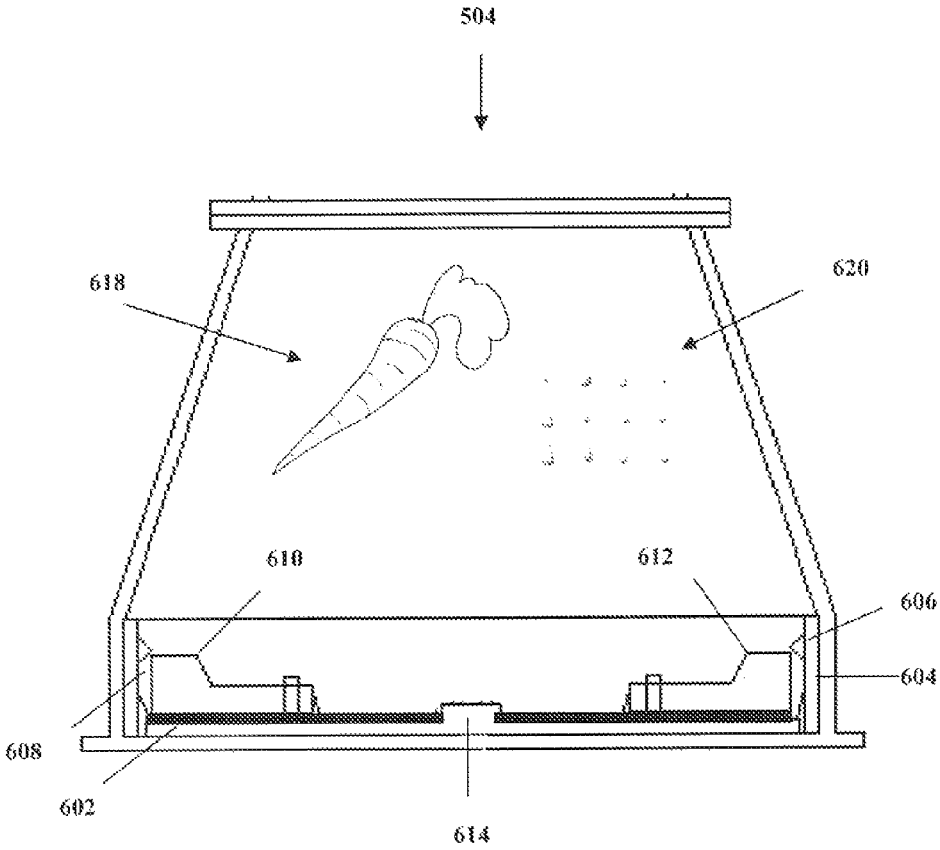
FIG. 6A shows a cross-sectional view of the grinding chamber, shown in FIG. 5, that represents an embodiment of the present invention.

FIG. 6A shows a cross-sectional view of the grinding chamber, shown in FIG. 5, that represents an embodiment of the present invention. The grinding chamber 504 includes a turntable 602, a shredder ring 604 comprising shredder ring notches, such as shredder ring notch 606, and a radial outlet 608, or gap, between the turntable 602 and the shredder ring 604. Two hammers 610 and 612 are attached by bolts to the turntable 602. The turntable 602 is attached to a motor shaft 614 that is connected to the motor 512.

Figure 6B:
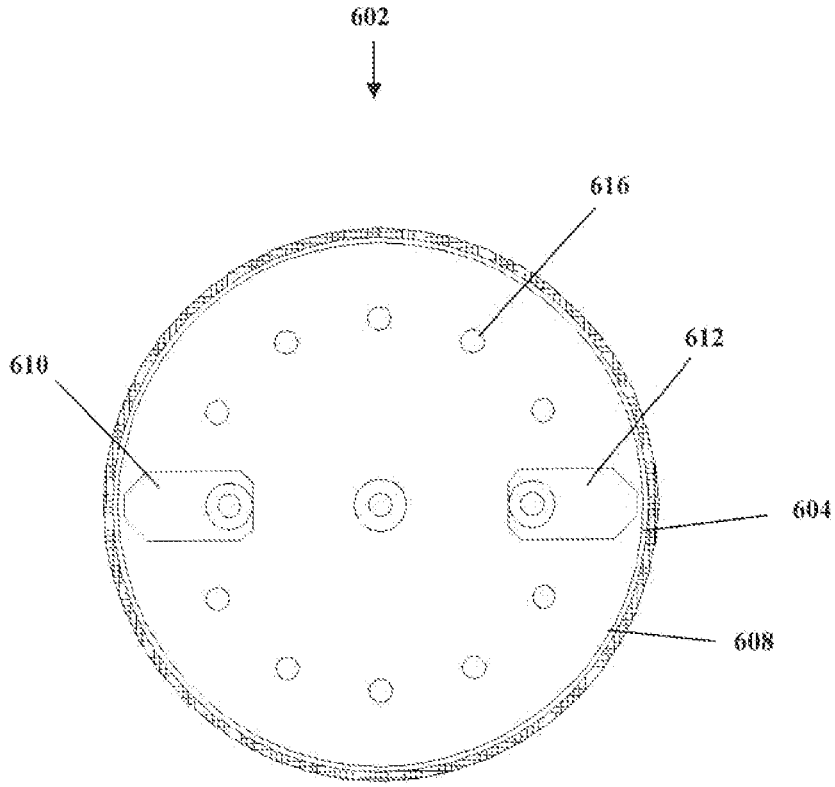
FIG. 6B shows a top view of the turntable and the shredder ring, shown in FIG. 6A, that represents an embodiment of the present invention.

FIG. 6B shows a top view of the turntable and shredder ring, shown in FIG. 6A, that represents an embodiment of the present invention. The turntable 602 includes the two hammers 610 and 612, and a number of turntable holes, such as turntable hole 616. The two hammers 610 and 612 are loosely attached to the turntable 602 and allowed to rotate freely.

Referring to FIGS. 6A-6B, food waste 618 and wastewater 620 fall onto the turntable 602 after entering the grinding chamber 504. During operation, the motor 512 rotates the turntable 602 rapidly and the food waste 618 and wastewater 620 are forced outward by centrifugal forces from the center of the turntable 602 against the shredder ring 604. Food waste 618 is shredded by the two hammers 610 and 612 that grind the food waste 618 against the shredder ring notches as the turntable 602 rotates. Shredded food waste 618 and wastewater 620 exit the grinding chamber 504, through the radial outlet 608 between the turntable 602 and the shredder ring 604, and fall onto the centrifugal-pump chamber 506, shown in FIG. 5. When the motor 512 is not in operation, wastewater 620 freely drains out of the grinding chamber 504, through the turntable holes, such as turntable hole 616, into the centrifugal-pump chamber 506.

Figure 7A:
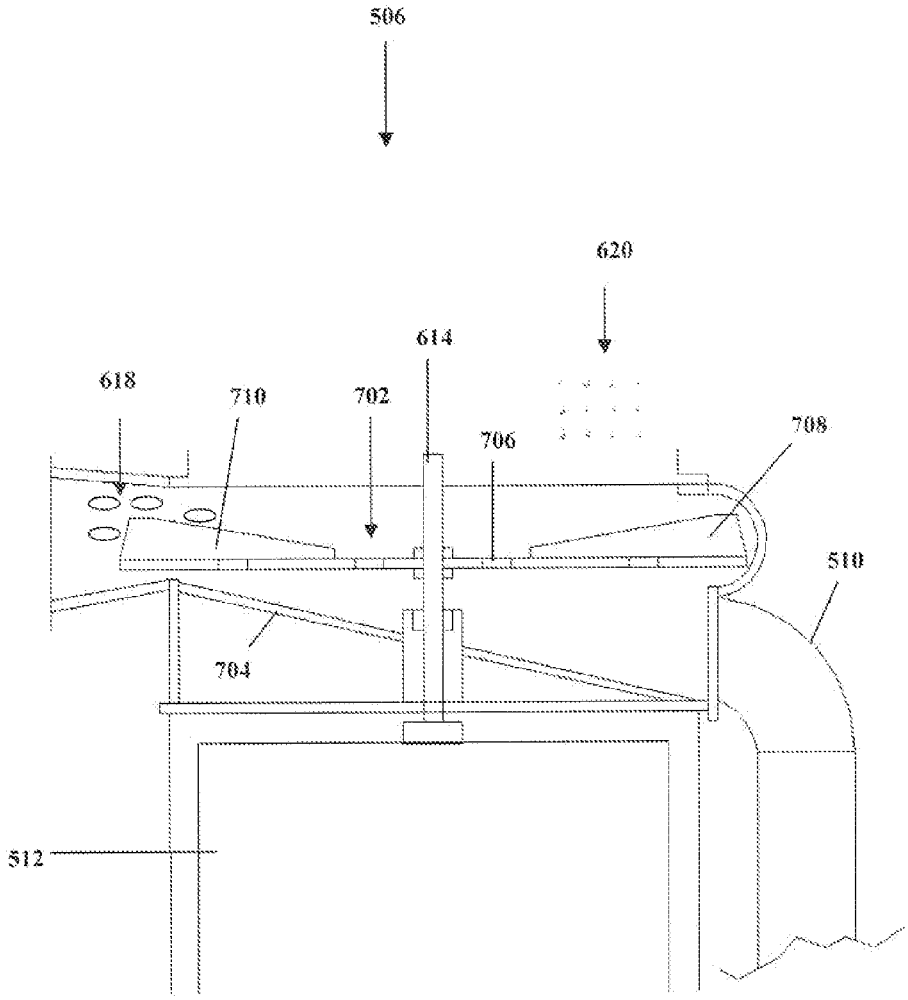
FIG. 7A shows a cross-sectional view of the centrifugal-pump chamber, shown in FIG. 5, that represents an embodiment of the present invention.

FIG. 7A shows a cross-sectional view of the centrifugal-pump chamber, shown in FIG. 5, that represents an embodiment of the present invention. The centrifugal pump chamber 506 includes an impeller disk 702, an intermediary sloped floor 704, and the motor shaft 614 connected to the motor 512. The impeller disk 702 includes a number of holes, such as impeller hole 706, and a number of impeller blades, such as impeller blades 708 and 710.

Figure 7B:
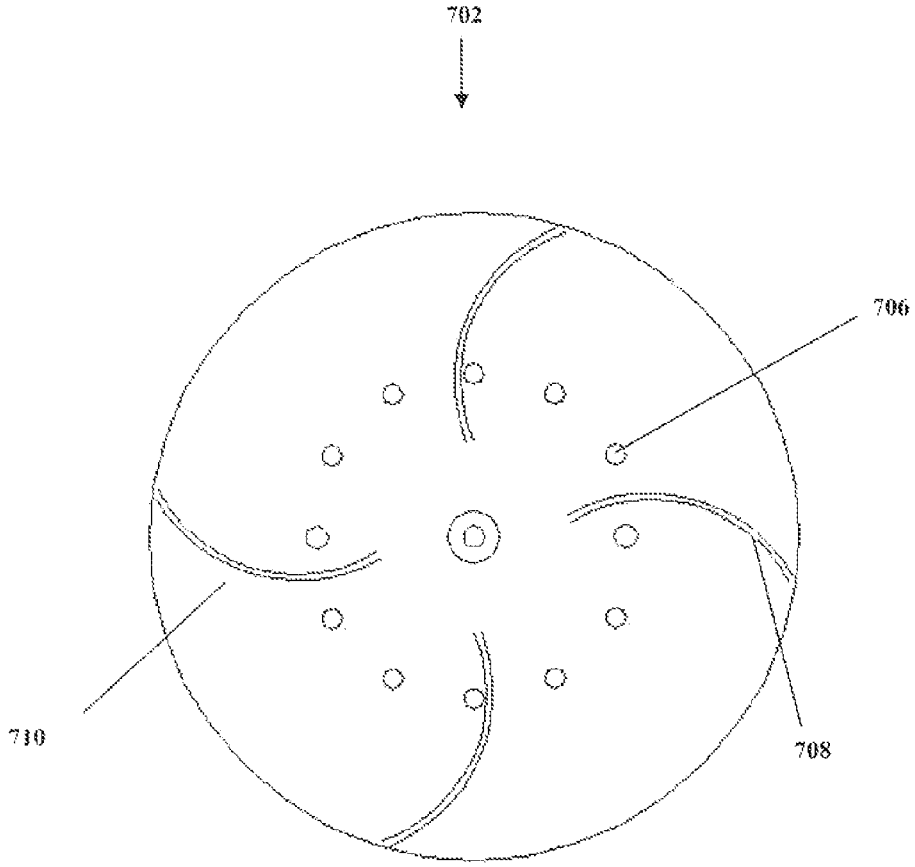
FIG. 7B shows a top view of the impeller disk, shown in FIG. 7B, that represents an embodiment of the present invention.

FIG. 7B shows a top view of the impeller disk, shown in FIG. 7B, that represents an embodiment of the present invention. The impeller disk 702 includes the impeller holes, such as impeller hole 706, and the impeller blades, such as impeller blades 708 and 710.

Referring to FIGS. 7A-7B, ground food waste 618 and wastewater 620 enter the centrifugal-pump chamber 506, after exiting the grinding chamber 504, and fall on the impeller disk 702. During operation, the impeller disk 702 is rotated by the motor 512, creating centrifugal forces that accelerate the food waste 618 and the wastewater 620, and force the food waste 618 and wastewater 620 radially outward to the perimeter of the impeller disk 702. The impeller blades assist in moving the food waste 618 and wastewater 620 outward to the perimeter of the impeller disk 702, and outward against the sides of the centrifugal-pump chamber 506. The food waste 618 and the wastewater 620 build up against the sides of the centrifugal-pump chamber 506 and are swept through to the straining chamber 508 by the rotation of the impeller disk 702. When the motor 512 is not in operation, the wastewater 620 passes through a number of holes, such as impeller hole 706, in the impeller disk 702 onto the intermediary sloped floor 704, and exits the system through the disposal outlet 510.

Figure 7C:
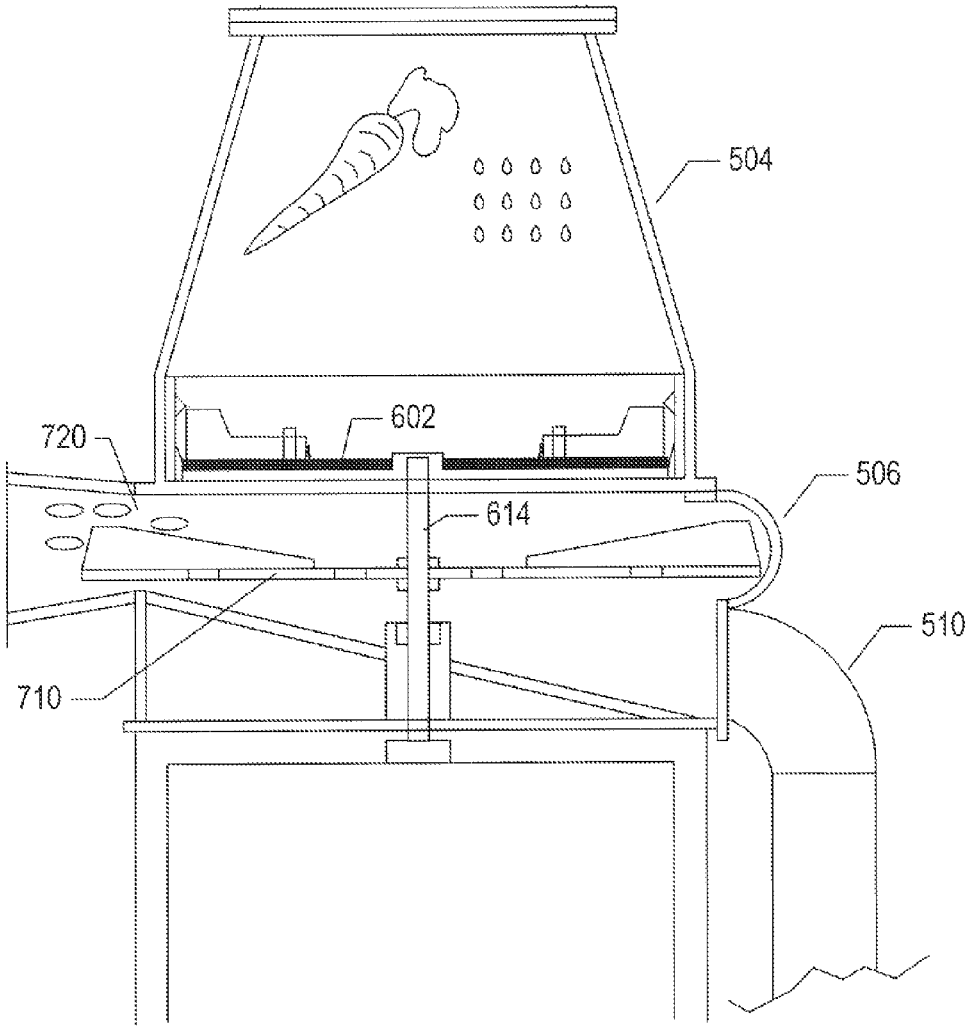
FIG. 7C shows a cross-sectional view of the grinding chamber, shown in FIGS. 5 and 6A, connected to the centrifugal-pump chamber, shown in FIGS. 5 and 7A, that represents an embodiment of the present invention.

FIG. 7C shows a cross-sectional view of the grinding chamber, shown in FIGS. 5 and 6A, connected to the centrifugal-pump chamber, shown in FIGS. 5 and 7A, that represents an embodiment of the present invention. The grinding chamber 504 is mounted above the centrifugal-pump chamber so that water and ground waste flow out through the internal radial outlet (608 in FIG. 6M and down into the centrifugal-pump chamber under the force of gravity. The upper outlet 720 receives ground waste and water when the impeller disk is rotated, and the lower outlet 510 receives water when the impeller disk is not rotated.

Figure 8:
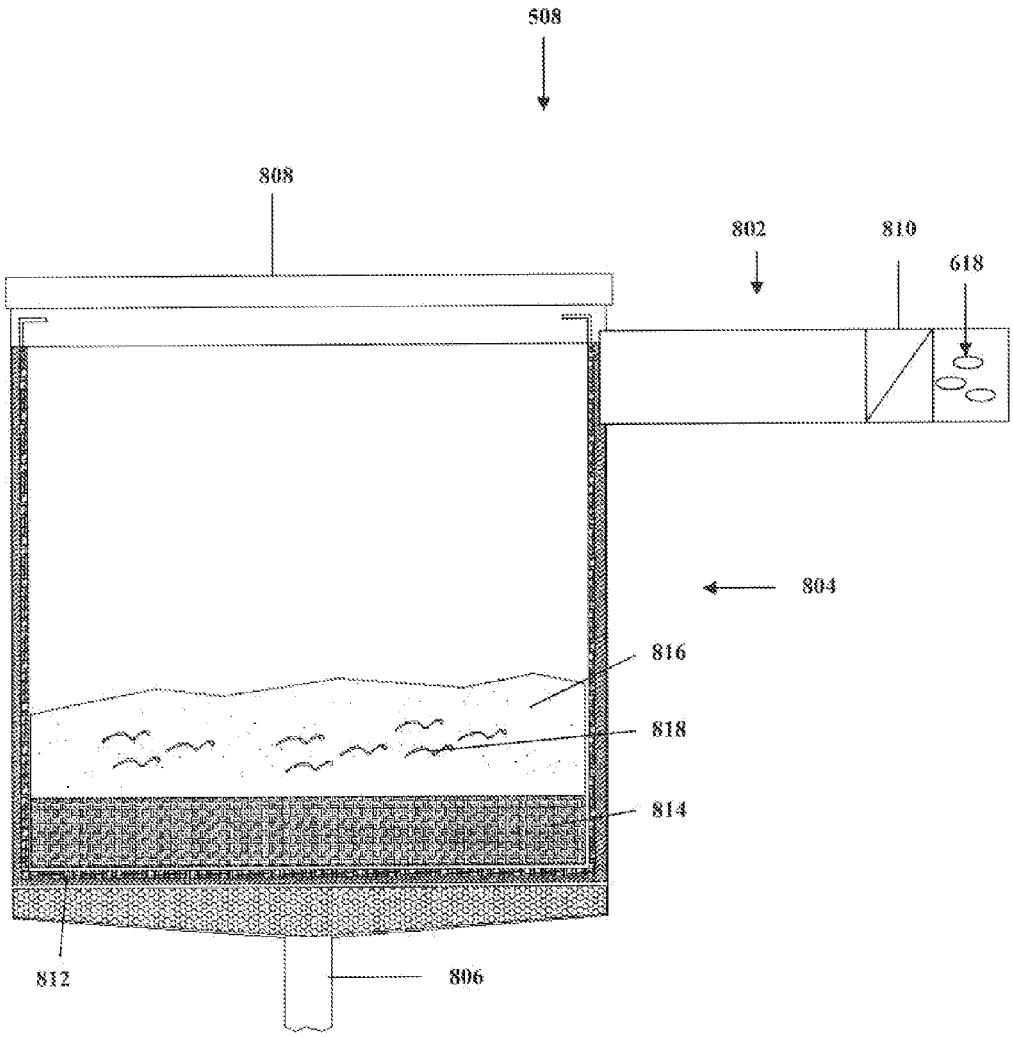
FIG. 8 shows a cross-sectional view of the straining chamber, shown in FIG. 5, that represents an embodiment of the present invention.

FIG. 8 shows a cross-sectional view of the straining chamber, shown in FIG. 5, that represents an embodiment of the present invention. The straining chamber 508 includes a straining chamber inlet pipe 802, a straining chamber housing 804, a straining chamber outlet pipe 806, and a straining chamber housing cover 808. The straining chamber inlet pipe 802 includes a check valve 810. The straining chamber housing 804 includes a cylindrical filtration basket 812, filter media 814, organic bedding 816, and worms 818. The side walls of the straining chamber housing 804 include ribbing for supporting the filtration basket 812. The filtration basket 812 is cylindrical, composed of porous material, including a number of holes having a diameter of three hundred to three thousand microns, and an open top and a closed bottom. In an alternate embodiment of the present invention, the straining chamber 508 comprises the filtration basket 812, straining chamber inlet pipe 802, the straining chamber housing cover 808, and the straining chamber outlet pipe 806 only. In further alternative embodiments of the present invention, the straining chamber housing 804 comprises the filtration basket 812 only. In an additional alternative embodiment of the present invention, the straining chamber housing 804 and filtration basket 812 include side and top walls.

Referring to FIG. 8, the ground food waste 618 and the wastewater 620 enter the straining chamber 508 and flow down the inlet pipe 802 towards the straining chamber housing 804. During operation, the food waste 618 and the wastewater 620 drop into the filtration basket 812 and flow onto the organic bedding 816 filled with worms 818. Worms 818 ingest ground food waste 618 through the vermicomposting process creating compost. Wastewater 620 drains through the filter media 814 and the filtration basket 812, flows through drainage channels in the bottom of the straining chamber housing 804, and flows out the straining chamber outlet pipe 806. The compost produced by the vermicomposting process can be periodically removed by removing the straining chamber housing cover 808, detaching the filtration basket 812 from the side walls of the straining chamber housing 804, and lifting the filtration basket 812 out of the straining chamber housing 804. The check valve 810 prevents the food waste 618 and the wastewater 620 from moving back into the centrifugal-pump chamber 506 when the motor 512 is not in operation. In an alternative embodiment of the present invention, the ground food waste 618 and the wastewater 620 enter a straining chamber 508 comprising a filtration basket 812 and a straining chamber outlet pipe 806 only.

Additional modifications within the spirit of the invention will be apparent to those skilled in the art. In an alternative embodiment of the present invention, a waste disposal system can be positioned above or below a counter. In further alternative embodiments of the present invention, a straining chamber can be located higher or lower than a centrifugal-pump chamber. A straining chamber housing and a filtration basket can be cylindrical or rectangular. A straining chamber can include side walls free of ribbing. Filter media can include course materials, such as wood. The thickness of filter media in a filtration basket can range from two to six inches and include pine bark, wood chips and inorganic material, such as stone. The thickness of organic bedding in a filtration basket can range from two to six inches and include peat moss, saw dust, and stable compost. Organic bedding can include worms and other invertebrates. Heating mats can be added to the organic bedding to support a vermicomposting environment. A straining chamber housing can be designed to hold a range of twenty to two-hundred gallons of water. A sump pump can be attached to a straining chamber outlet pipe for pumping liquid from a strainer to a disposal outlet. A straining chamber outlet pipe can be connected to a sewer pipe, irrigation pipe, or other disposal.

The foregoing detailed description, for purposes of illustration, used specific nomenclature to provide a thorough understanding of the invention. However, it will be apparent to one skilled in the art that the specific details are not required in order to practice the invention. Thus, the foregoing descriptions of specific embodiments of the present invention are presented for purposes of illustration and description; they are not intended to be exhaustive or to limit the invention to the precise forms disclosed. Obviously many modifications and variation are possible in view of the above teachings. The embodiments were chosen and described in order to best explain the principles of the invention and its practical applications and to thereby enable others skilled in the art to best utilize the invention and various embodiments with various modifications as are suited to the particular use contemplated.

The invention claimed is:

1. A kitchen-sink waste-disposal system comprising:
an electric motor;
a disposal inlet connected to a kitchen-sink drain through which the kitchen-sink waste-disposal system receives waste and water from the kitchen-sink drain;
an upper outlet to which ground waste and water is directed when the electric motor is operating;
a lower outlet to which received water flows;
a grinding chamber that includes a grinding turntable driven by a motor shaft that interconnects the electric motor to the grinding turntable, a number of hammers affixed to the grinding turntable, and a radial internal outlet through which ground waste and water flows to a centrifugal-pump chamber below the grinding chamber; and
the centrifugal-pump chamber within which an impeller disk is mounted to the motor shaft, the impeller disk including a plurality of impeller blades that, when the impeller disk is rotated by rotational motion transferred to the motor shaft by the electrical motor, force ground waste and water out to the upper outlet in the wall of the centrifugal pump chamber, the impeller disk also including a plurality of apertures through which water flows to the lower outlet below the impeller disk.

2. The kitchen-sink waste-disposal system of claim 1 wherein the upper outlet is connected to a straining chamber inlet pipe leading to a straining chamber that includes a filtration basket for separating ground waste from water.

3. The kitchen-sink waste-disposal system of claim 2 wherein the filtration basket includes worms for vermicomposting the ground waste.

4. The kitchen-sink waste-disposal system of claim 1 wherein the centrifugal-pump chamber further includes a sloped member below the impeller disk to direct water to the lower outlet when the impeller disk is not rotating.

* * * * *